US006263902B1

(12) United States Patent
Booth

(10) Patent No.: US 6,263,902 B1
(45) Date of Patent: Jul. 24, 2001

(54) TANK FOR GASEOUS FUELS WITH ADDITIONAL INTERNAL RESERVOIR

(75) Inventor: Wayne A. Booth, 770 Queenston Road, Apt. 707, Hamilton (CA), L8G 1A6

(73) Assignees: Wayne A. Booth; Patrick W. Gorda, both of Hamilton (CA)

( * ) Notice: Subject to any disclaimer, the term of this patent is extended or adjusted under 35 U.S.C. 154(b) by 0 days.

(21) Appl. No.: 09/603,555

(22) Filed: Jun. 26, 2000

(51) Int. Cl.[7] ..... F17C 1/00
(52) U.S. Cl. ..... 137/264; 220/582; 220/23.87
(58) Field of Search ..... 137/264; 220/501, 220/502, 505, 581, 582, 23.87

(56) References Cited

U.S. PATENT DOCUMENTS 1,533,299 4/1925 Armknecht .
1,692,670 11/1928 Le Mesurier .
2,019,004 10/1935 Endacott .
3,277,931 * 10/1966 Emrick ..... 137/264 X
3,344,439 * 10/1967 Davies ..... 137/264 X
5,429,267 7/1995 San .

* cited by examiner

*Primary Examiner*—Kevin Lee
(74) *Attorney, Agent, or Firm*—Patrick J. Hofbauer

(57) ABSTRACT

A storage tank for storing and selectively dispensing pressurized combustible fluid comprises a main tank having a delivery outlet, and a first valve mounted on the main tank in fluid communication with the delivery outlet for controlling the flow of the pressurized combustible fluid from within the main tank to the ambient surroundings. A reserve tank is mounted in supported relation on the main tank and has a reserve outlet disposed within the main tank to permit direct fluid delivery from the reserve tank into the main tank. A selectively openable and closable second valve is mounted on one of the main tank and the reserve tank in operative connection with the reserve outlet for selective movement between a closed configuration whereat flow of the pressurized combustible fluid from the reserve tank through the reserve outlet to the main tank is precluded, and an open configuration whereat flow of the pressurized combustible fluid from the reserve tank through the reserve outlet to the main tank is permitted.

15 Claims, 5 Drawing Sheets

TANK FOR GASEOUS FUELS WITH ADDITIONAL INTERNAL RESERVOIR

FIELD OF THE INVENTION

The present invention relates to metal storage tanks for storing and selectively dispensing pressurized combustible fluids, and more particularly to such tanks for storing and dispensing pressurized propane and natural gas, which storage tanks provide a reserve capacity to preclude unexpectedly depleting the entire supply of propane.

BACKGROUND OF THE INVENTION

It is common to use metal storage tanks filled with liquid propane under high pressure for various purposes, primarily for domestic purposes, such as cooking and heating. A single manually operable valve disposed at the top of the tank permits selective proportional release of the propane from the tank, thus permitting control of the amount of heat generated by the gas as it combusts.

Such conventional "propane" tanks typically have a fixed volume of about ten litres and require periodic refilling. Such refilling is preferably done when the propane tank is nearly depleted. However, it is quite common to be using the propane tank when it becomes depleted, and is therefore suddenly unusable. Such depletion is common even if the propane tank is equipped with a pressure gauge that indicates the amount of propane remaining in the tank due to imprecision of such gauges. Such unexpected depletion of propane is highly undesirable and is addressed in various manners in the prior art by providing ganged tanks connected in fluid communication one with another. More specifically, "double" propane tanks having a smaller auxiliary tank inside a main tank are known, where the propane inside the smaller auxiliary tank is useable when the propane inside the main tank is depleted.

An example of one such "double" propane tank is found in U.S. Pat. No. 5,429,627 to San entitled Sub-Cylinder for Liquified Petroleum Gas, wherein a cylinder comprises an outer main cylinder and an interiorly mounted sub-cylinder, each cylinder having its own separate independent valve. The outer cylinder is a conventional propane tank and the sub-cylinder is adapted to fit into the threaded aperture that otherwise would receive a pressure gauge. This structure has been proven to be advantageous in terms of ease and familiarity of manufacturing, and also for consumer acceptance as it maintains the appearance and functionality of standard conventional propane tanks.

In use, if the propane has been depleted from the main cylinder of San, the delivery hose can be moved from the main cylinder's valve to the reserve cylinder's valve, thus extending use of the propane tank for a brief period of time, so as to allow, for example, completion of the meal currently being cooked on a propane barbeque or grill. However, such moving of the delivery hose from one valve to the other is extremely inconvenient, especially considering that the flow of propane will be interrupted, thus necessitating the relighting of the apparatus when the propane flow is renewed from the reserve cylinder.

One prior art tank that overcomes the problem of moving the delivery hose from the main tank to the reserve tank is disclosed in U.S. Pat. No. 2,019,004 to Endacott entitled Liquefied Gas Tank, wherein the flow of gas from a large main tank is controlled by a main valve, and the flow of gas from a smaller reserve tank is controlled by a secondary valve through the main valve. However, this arrangement is decidedly disadvantageous in that the external valving mechanisms are undesirably large and cumbersome, thus requiring significant modification to existing main propane tanks in order to add such a valving mechanism, and thereby losing long established consumer acceptance of standardized tanks. Even with a safety ring, such an external valving mechanism is only partially protected and, accordingly, is prone to damage, and for this reason is less safe than is desirable. Further, such a valving mechanism is more expensive than is desirable for domestic-use propane tanks.

It is an object of the present invention to provide a storage tank for storing and selectively dispensing pressurized fuel fluids, particularly propane, which storage tank has a main tank and a reserve tank.

It is an object of the present invention to provide a storage tank for storing and selectively dispensing pressurized combustible fluids, particularly propane, which storage tank has a main tank similar to conventional propane tanks for the purpose of ease and familiarity of manufacturing.

It is an object of the present invention to provide a storage tank for storing and selectively dispensing pressurized combustible fluids, particularly propane, which storage tank employs a single valve for receiving a delivery hose.

It is an object of the present invention to provide a storage tank for storing and selectively dispensing pressurized combustible fluids, particularly propane, wherein the flow of propane is not interrupted when switching from the main tank to the reserve tank.

It is an object of the present invention to provide a storage tank for storing and selectively dispensing pressurized combustible fluids, particularly propane, wherein the external valving mechanism can be used with existing main propane tanks.

It is an object of the present invention to provide a storage tank for storing and selectively dispensing pressurized combustible fluids, particularly propane, wherein the overall valving mechanism is significantly less prone to damage than is the prior art.

It is an object of the present invention to provide a storage tank for storing and selectively dispensing pressurized combustible fluids, particularly propane, wherein the overall valving mechanism is easier and less expensive to manufacture than is the prior art.

SUMMARY OF THE INVENTION

In accordance with the present invention there is disclosed a storage tank for storing and selectively dispensing pressurized combustible fluid. The storage tank comprises a main tank having a delivery outlet, and a first valve means mounted on the main tank in fluid communication with the delivery outlet for controlling the flow of the pressurized combustible fluid from within the main tank to the ambient surroundings. A reserve tank is mounted in supported relation on the main tank and has a reserve outlet disposed within the main tank to permit direct fluid delivery from the reserve tank into the main tank. A selectively openable and closable second valve means is mounted on one of the main tank and the reserve tank in operative connection with the reserve outlet for selective movement between a closed configuration whereat flow of the pressurized combustible fluid from the reserve tank through the reserve outlet to the main tank is precluded, and an open configuration whereat flow of the pressurized combustible fluid from the reserve tank through the reserve outlet to the main tank is permitted.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the storage tank according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE INVENTION

Figure 1:
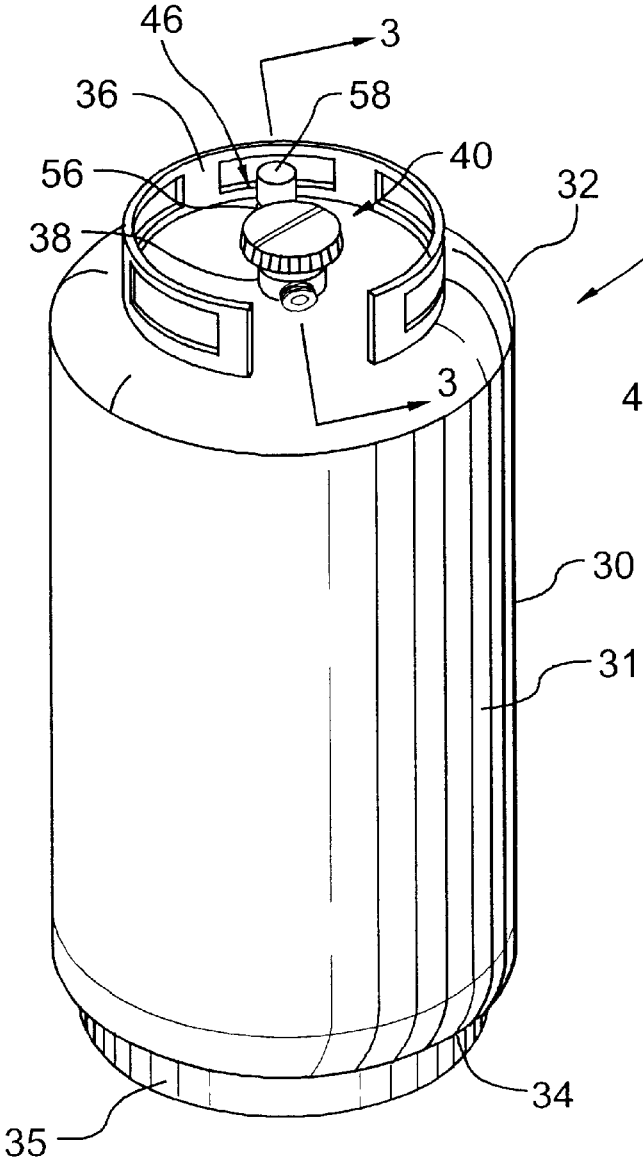
FIG. 1 is a perspective view of a preferred embodiment storage tank according to the present invention.
Figure 2:
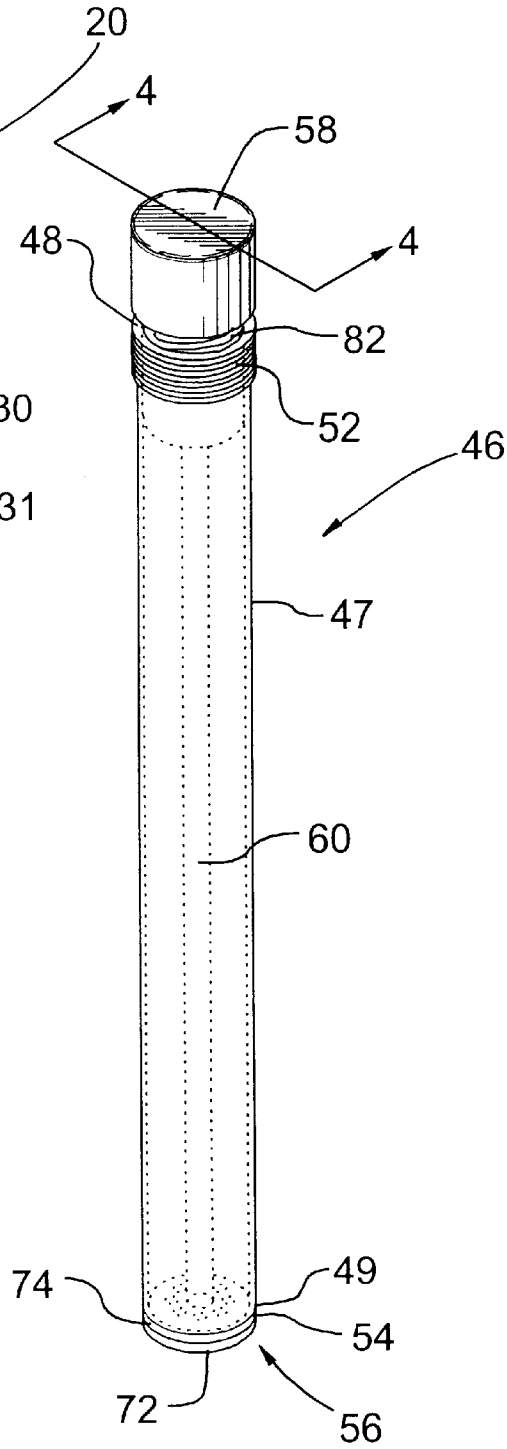
FIG. 2 is a perspective view of the reserve tank best seen in FIG. 3.

Reference will now be made to FIGS. 1 through 6, which figures show a preferred embodiment of the storage tank according to the present invention, as indicated by the general reference numeral 20. The storage tank 20 is for storing and selectively dispensing pressurized combustible fluids, such as propane and natural gas, to an appliance, such as conventional barbeques and heaters (not shown), and so on. The storage tank 20 may also be suitable for other analogous or similar domestic uses, or even light industrial use, where a supply of low pressure propane or natural gas is required. Typically, the storage tank 20 is refillable, but does not need to be in order for the present invention to have utility.

The storage tank 20 comprises a main tank 30 that is typically made from hot rolled steel or cold rolled steel and formed into the shape of a cylinder having a substantially cylindrically shaped outer wall 31 defining, an upper end 32, and a lower end 34, all formed together into one integral unit by means of welding, as appropriate. An annularly shaped metal safety ring 36 is welded to the top end of the main tank 30, in surrounding relation to a delivery outlet 38 of the main tank 30 (see FIG. 3), and doubles as a handle.

A first valve means 40 of conventional design is mounted on the main tank 30 in fluid communication with the delivery outlet 38 for controlling the flow of the pressurized combustible fluids, namely propane, from within the main tank 30 to the ambient surroundings. Typically, a conventional pressure regulator (not shown) is included in conjunction with the first valve means 40 or attached to the first valve means 40, in order to regulate the pressure of the propane being delivered from the main tank 30 through the delivery outlet 38. A conventional flexible hose (not shown) is connectable to the first valve means 40 for delivering propane to an appliance, such as a barbeque or a heater.

Figure 3:
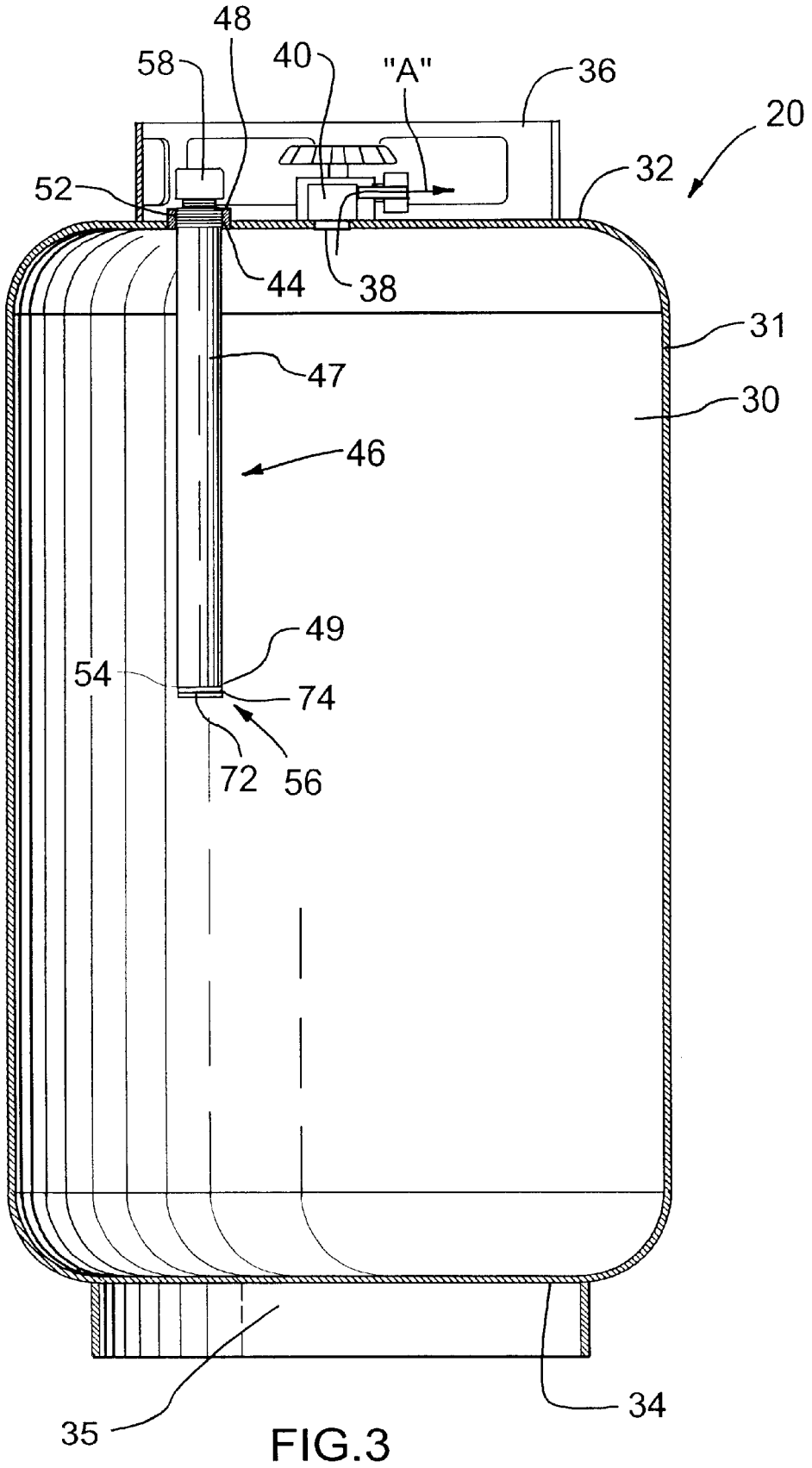
FIG. 3 is a sectional side elevational view of the preferred embodiment storage tank of FIG. 1, taken along section line 3—3 of FIG. 1.

As best seen in FIG. 3, a female threaded aperture 44 is disposed in the upper end 32 of the main tank 30, adjacent the delivery outlet 38, so as to be in surrounded relation by the safety ring 36. Conventionally, but not in the present invention as illustrated, the female threaded aperture 44 may be used to receive and retain a fuel pressure gauge (not shown), that is used to indicate the amount of propane remaining in the main tank 30.

A first reserve tank, as indicated by the general reference numeral 46, comprises a substantially cylindrically shaped outer wall 47 enclosing a hollow interior 51 (see FIGS. 4 and 5) and defining the width "W" of the reserve tank. The outer wall 47 adjoins an upper end 48 and a lower end 49, which upper 48 and lower 49 ends define the height "H" of the reserve tank 46. Preferably, the height of the reserve tank 46 and the width of the reserve tank 46 are in a ratio of greater than 8:1, and in the preferred embodiment, as illustrated, are in a ratio of about 12:1.

The reserve tank 46 is mounted in supported yet removable relation on the main tank 30, so as to be substantially within the interior of the main tank 30, by means of a complementary threaded male collar portion 52 welded or otherwise attached to or formed on the remainder of the substantially cylindrically shaped outer wall 31. The threaded male collar portion 52 engages the co-operating female threaded aperture 44 in the main tank 30. Although the reserve tank 46 would not typically be removed from the main tank 30, occasional removal may be necessary, for replacement or maintenance purposes, and so on. Further, it is contemplated that, depending on the particular embodiment of the storage tank 20 of the present invention, it is possible that subsequent similar reserve tanks could be interchangeable with the reserve tank 46 illustrated, so as to provide for an even greater reserve supply of propane.

A reserve outlet 54 is disposed at the lower end 49 of the reserve tank 46. In this manner, the reserve outlet 54 is disposed in the assembled configuration of FIGS. 1 and 3, within the main tank 30 so as to permit direct fluid delivery from the reserve tank 46 into the main tank 30.

Figure 4:
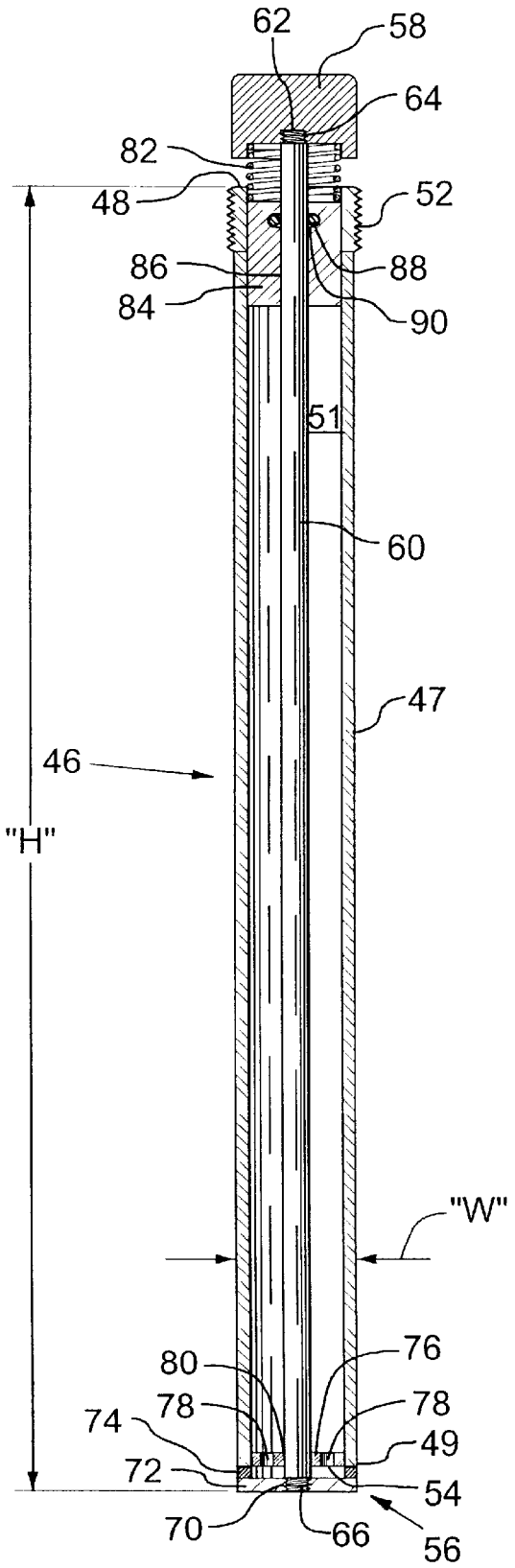
FIG. 4 is an enlarged sectional view of the reserve tank of FIG. 3 taken along section line 4—4 of FIG. 2, with the second valve in a closed configuration.
Figure 5:
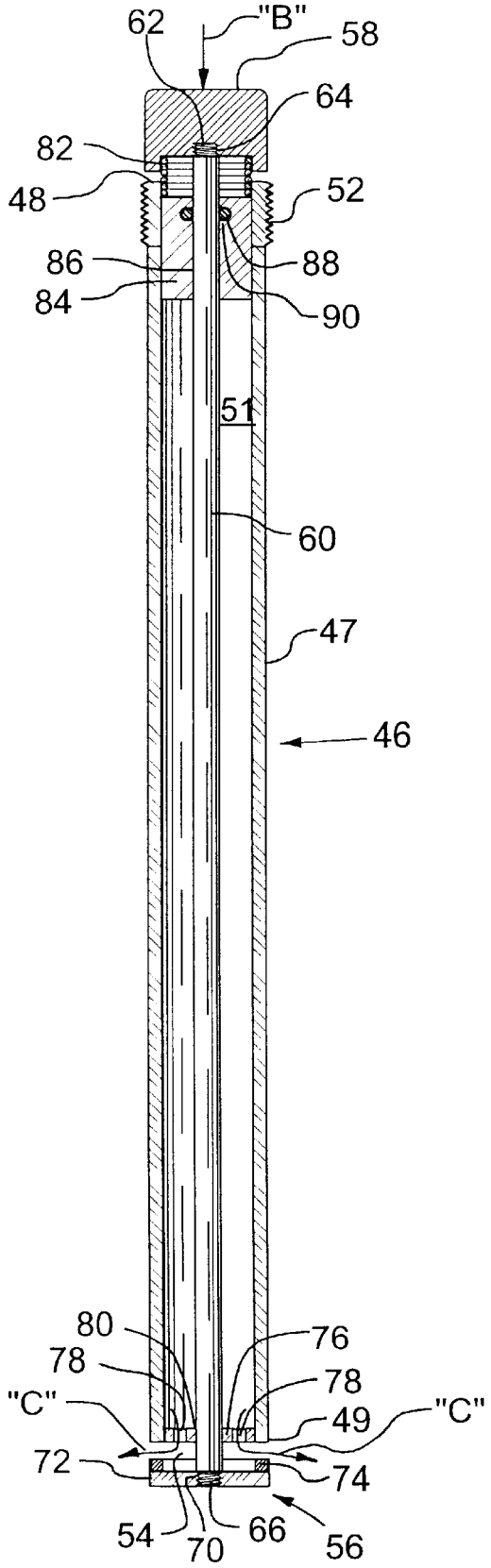
FIG. 5 is a view similar to FIG. 4, but with the second valve in an open configuration; and, FIG. 6 is an exploded side elevational view of the reserve tank of FIG. 2.
Figure 6:
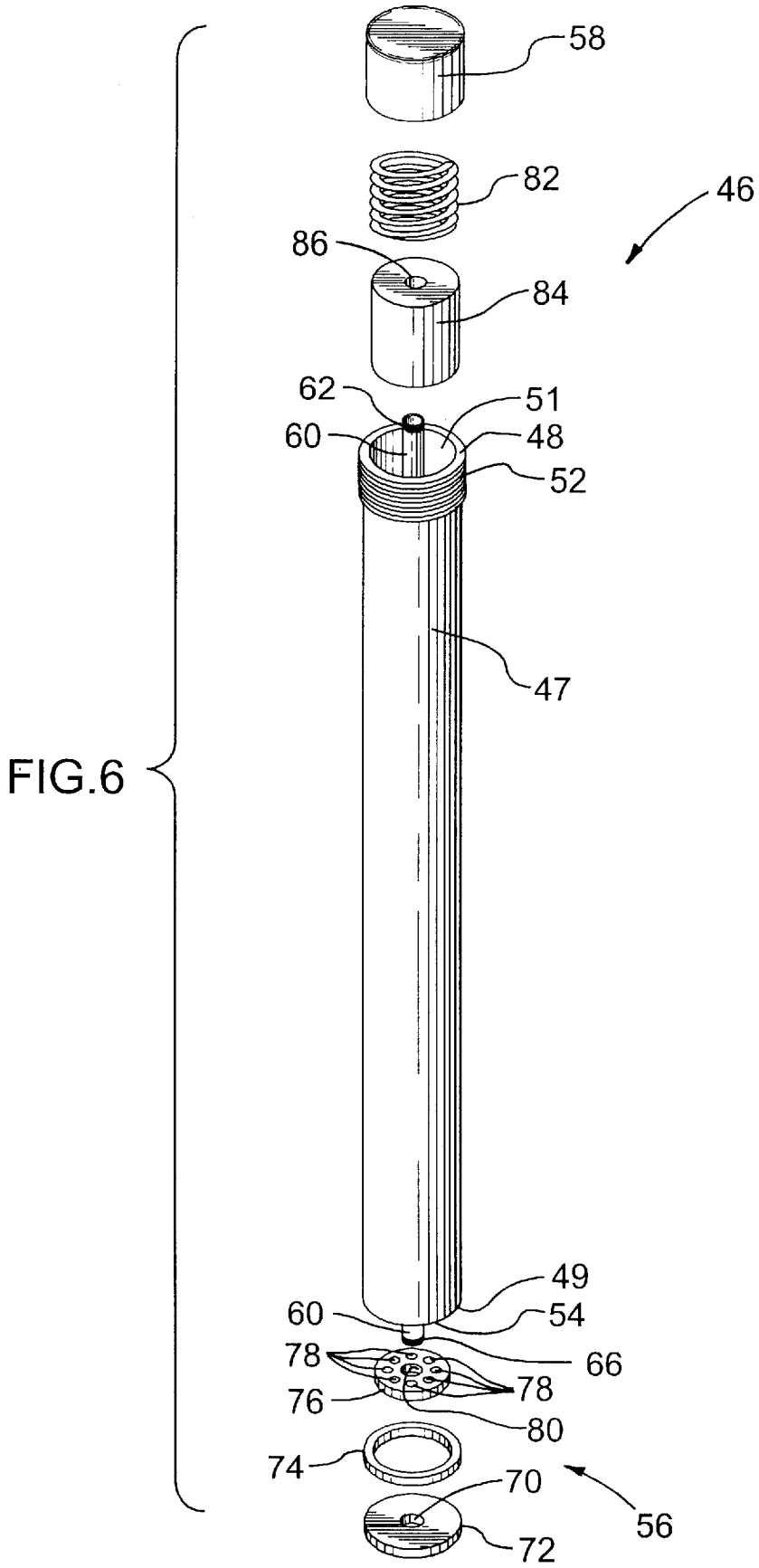

A selectively openable and closable second valve means, indicated by the general reference numeral 56, is mounted on the reserve tank 46 in operative connection with the reserve outlet 54. The selectively openable and closable second valve means 56 is mounted, as aforesaid, for selective movement between a closed configuration and an open configuration. In the closed configuration, as is best seen in FIG. 4, the flow of the pressurized combustible fluids, namely propane, from the reserve tank 46 through the reserve outlet 54 to the main tank 30, is precluded by the second valve means 56, such that the reserve tank 46 is then separately pressurized and completely sealed off from both the main tank 30 and the ambient surroundings. In contrast, in the open configuration, as is best seen in FIG. 5, the flow of the pressurized combustible fluid from the reserve tank 46 through the reserve outlet 54 to the main tank 30 is permitted, as indicated by arrows "C".

The selectively openable and closable second valve means 56 is manually operable between its open configuration and its closed configuration by means of a control handle 58 mounted on the reserve tank 46 so as to be disposed at the exterior of the reserve tank 46, above the upper end 48 of the reserve tank 46. In this manner, the control handle 58 is disposed at the exterior of the main tank 30, thereby being easily accessible by an operator's hand.

The control handle 58 is operatively connected to the selectively openable and closable second valve means 56 by means of an elongate rod member 60 passing through the hollow interior 51 of the reserve tank 46. The elongate rod member 60 has a threaded upper end portion 62 that engages a co-operating threaded bore 64 in the control handle 58 and a threaded lower end portion 66 that threadably engages a co-operating threaded bore 70 in a closure cap 72. The closure cap 72 is thereby mounted on the elongate rod member 60 for movement between a closed position, as is best seen in FIG. 4, corresponding to the closed configuration of the second valve means 56, whereat the closure cap 72 engages the lower end 49 of the substantially cylindrically shaped outer wall 47 in sealing relation, and an open position corresponding to the open configuration of the second valve means 56 whereat the closure cap 72 is removed from the aforesaid sealing relation and is disposed in spaced relation from the lower end 49 of the substantially cylindrically shaped outer wall 47.

In the preferred embodiment as illustrated, the closure cap 72 comprises an annular rubber seal 74 mounted on the closure cap 72 for assisting in providing the sealing relation with the lower end 49 of the substantially cylindrically shaped outer wall 47. The selectively openable and closable second valve means 56 also includes an annular flow ring 76 disposed at the lower end 49 of the reserve tank 46, which flow ring 76 serves to strengthen the reserve tank 46 at its lower end 49, in response to the pressure of the propane contained in the reserve tank 46. The flow ring 76 has a plurality of flow orifices 78 therein for permitting the flow of propane from the reserve tank 46 through the flow ring 76 into the main tank 30. A rod-receiving aperture 80 is centrally disposed in the flow ring 76 to receive the elongate rod member 60 in sliding through passing relation therein.

Similarly, an upper end plug 84 is disposed adjacent the upper end 48 of the reserve tank 46, which upper end plug 84 serves to partially close off the upper end 48 of the reserve tank 46. A rod-receiving aperture 86 is centrally disposed in the upper end plug 84 to receive the elongate rod member 60 in sliding through passing relation therein. A rubber "O"-ring 88 is preferably disposed in sealing relation within an annular groove 90 in the aperture 86, and also so as to be in slidable sealing relation with the elongate rod member 60, thereby precluding the escape of propane through the upper end 48 of the reserve tank 46.

A coil spring 82 is preferably seated at the top portion of the substantially cylindrically shaped outer wall 47 atop the upper end plug 84, so as to bias the control handle 58 upwardly such that the second valve means 56 is biased to its closed configuration.

In the preferred embodiment illustrated, the substantially cylindrically shaped outer wall 47, the upper end plug 84, the annular flow ring 76, and the closure cap 72 are constructed from aluminum so as to be sufficiently strong, but light in weight; alternatively they may be made from any other suitable materials.

In normal use of the propane tank 20, the propane is delivered from the main tank 30 through the first valve means 40, as indicated by arrow "A" in FIG. 3. When the supply of propane in the main tank 30 has been depleted to a pressure level where it is apparent that the supply in the tank is about to run out, or perhaps the supply has run out, or perhaps the pressure is so low that cooking or heating can no longer take place, then the second valve means 56 on the reserve tank 46 is moved from its closed configuration, as shown in FIG. 4, to its open configuration, as indicated by the path of arrow "B" in FIG. 5, to permit the flow of propane through the flow orifices 78 in the flow ring 76, as indicated by arrows "C". In this manner, a few minutes supply of propane would be available from the reserve tank 46 to the device that is attached to the main tank 30 for use, so that cooking and heating can be finished off, or a new supply of propane can be obtained.

Figure 7:
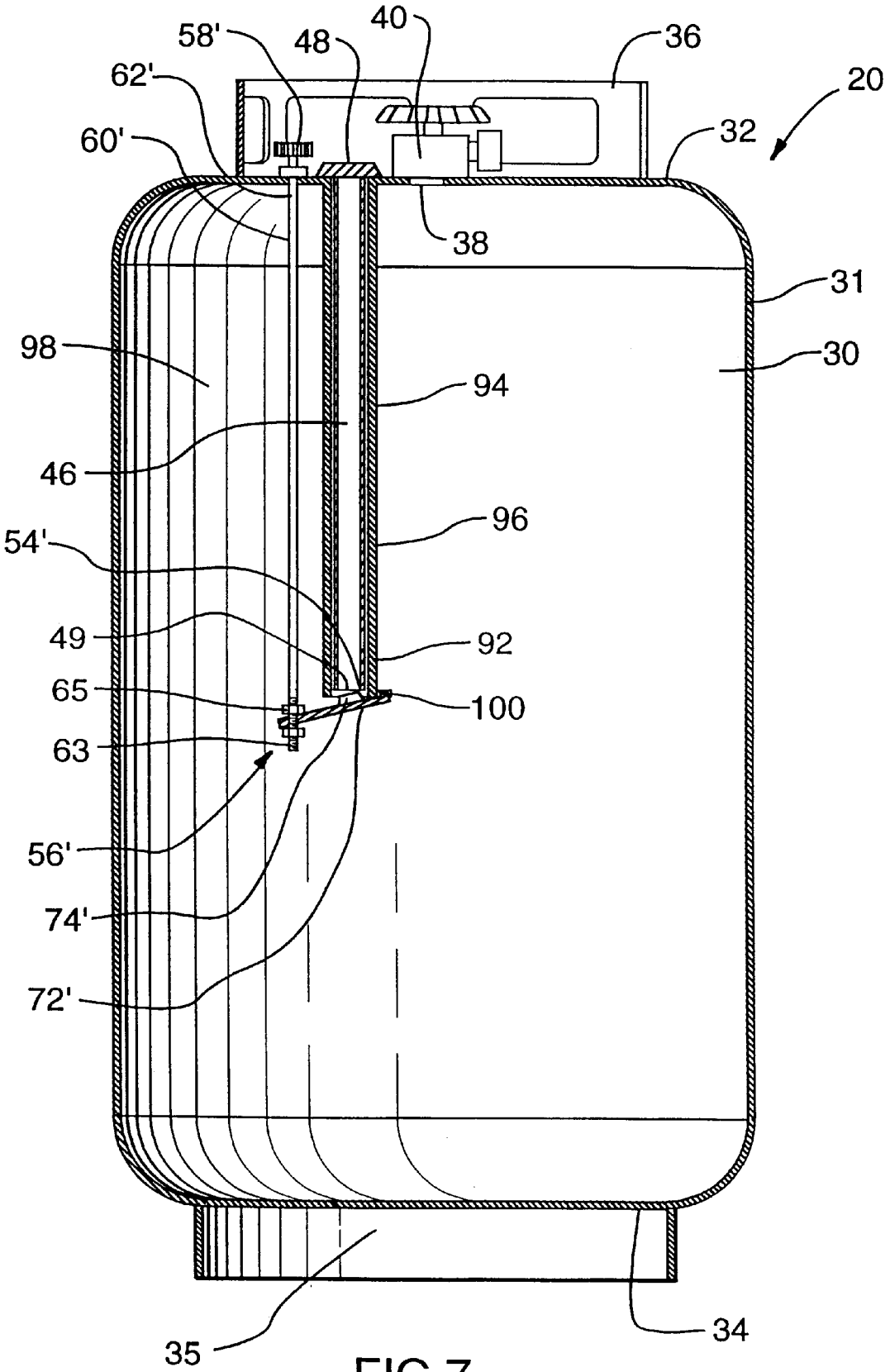
FIG. 7 is a sectional side elevational view of an alternate embodiment storage tank according to the present invention.

An alternate embodiment of the invention is illustrated in FIG. 7. In this embodiment, a selectively openable and closable second valve means 56' is mounted at a lower end 92 of a reverse boss 94 having a substantially cylindrically shaped vertical wall 96 extending downwardly from the upper end 32 of the main tank 30. A cylindrical reserve tank 46 is mounted on the main tank 30, concentrically within the reverse boss 94, and comprises an upper end 48 and a lower end 49, with a reserve outlet 54' disposed at its lower end 49. As such, the second valve means 56' is mounted on the main tank 30 in operative connection with the reserve outlet 54' of the reserve tank 46. It is to be noted that, in FIG. 7, the same reference numerals have been used to indicate objects, surfaces, and components which are common to both the preferred embodiment of FIGS. 1 to 6 and the alternate embodiment of FIG. 7.

The selectively openable and closable second valve means 56' is manually operable between an open configuration and a closed configuration by means of a control handle 58' extending from the exterior of the upper end 32 of the main tank 30, thereby being easily accessible by an operator's hand. The control handle 58' is operatively connected to the second valve means 56' by means of an elongate rod member 60' passing through the hollow interior 98 of the main tank 30. The elongate rod member 60' has a threaded upper end portion 62'. The elongate rod member 60' also has a threaded lower end portion 63 with two hex nuts 65 affixed thereto, in vertically spaced relation to each other, such that a length between the two hex nuts 65 on the elongate rod member 60' slidably and rotatably engages a slot (not shown) in a closure cap 72'. The closure cap 72' is mounted by way of a hinge 100 adjacent the lower end 92 of the reverse boss 94. As such, the closure cap 72', through its engagement with the elongate rod member 60', may be moved between a closed position (not shown) and an open position (as depicted in FIG. 7). The closed position corresponds to the closed configuration of the second valve means 56', whereat a rubber plug 74' affixed to the closure cap 72' engages the lower end 49 of the reserve tank 46 in sealing relation, such that the flow of the pressurized combustible fluids from the reserve tank 46, through the reserve outlet 54' to the main tank 30, is precluded by the second valve means 56', and such that the reserve tank 46 is then separately pressurized and completely sealed off from both the main tank 30 and the ambient surroundings. The open position corresponds to the open configuration of the second valve means 56' (as illustrated in FIG. 7) whereat the rubber plug 74' is removed from the aforesaid sealing relation and is disposed in spaced relation from the lower end 49 of the reserve tank 46, thereby to allow the escape of combustible fluids from the reserve tank 46, through the reserve outlet 54', to that main tank 30.

Other modifications and alterations may be used in the design and manufacture of the storage tank 20 according to the present invention without departing from the spirit and scope of the invention, which is limited only by the accompanying claims.

What is claimed is:

1. A storage tank for storing and selectively dispensing pressurized combustible fluid, said storage tank comprising:

a main tank having a delivery outlet;

first valve means mounted on said main tank in fluid communication with said delivery outlet for controlling the flow of said pressurized combustible fluid from within said main tank to the ambient surroundings;

a reserve tank mounted in supported relation on said main tank and having a reserve outlet disposed within said main tank to permit direct fluid delivery from said reserve tank into said main tank; and, selectively openable and closable second valve means mounted on one of said main tank and said reserve tank in operative connection with said reserve outlet for independent selective movement between a closed configuration whereat flow of said pressurized combustible fluid from said reserve tank through said reserve outlet to said main tank is precluded so as to separately pressurize said reserve tank in sealed off relation from both said main tank and said ambient surroundings, and an open configuration whereat flow of said pressurized combustible fluid from said reserve tank through said reserve outlet to said main tank is permitted.

2. The storage tank according to claim 1, wherein said selectively openable and closable second valve means is mounted on said reserve tank in said operative connection with said reserve outlet.

3. The storage tank according to claim 1, wherein said selectively openable and closable second valve means is mounted on said reserve tank so as to be disposed within the interior of said main tank.

4. The storage tank according to claim 3, wherein said reserve tank is mounted in supported relation substantially within the interior of said main tank.

5. The storage tank according to claim 4, wherein said selectively openable and closable second valve means is manually operable between said open configuration and said closed configuration by means of a control handle mounted on said reserve tank so as to be disposed at the exterior of said main and said reserve tanks.

6. The storage tank according to claim 5, wherein said reserve tank comprises a substantially cylindrically shaped outer wall defining the width of said reserve tank, which outer wall adjoins upper and lower ends defining the height of said reserve tank.

7. The storage tank according to claim 6, wherein said selectively openable and closable second valve means is disposed adjacent said lower end of said reserve tank.

8. The storage tank according to claim 7, wherein said control handle of said selectively openable and closable second valve means is disposed above said upper end of said reserve tank.

9. The storage tank according to claim 8, wherein said control handle is operatively connected to said selectively openable and closable second valve means by means of an elongate rod member passing through the body of said reserve tank.

10. The storage tank according to claim 9, wherein said selectively openable and closable second valve means comprises a closure cap mounted on said elongate rod member for movement between a closed position corresponding to said closed configuration of said second valve means, whereat said closure cap engages the lower end of said substantially cylindrically shaped outer wall in sealing relation, and an open position corresponding to the open configuration of said second valve means, whereat said closure cap is removed from said sealing relation and is disposed in spaced relation from the lower end of said substantially cylindrically shaped outer wall.

11. The storage tank according to claim 10, wherein said closure cap comprises an annular rubber seal mounted thereon for providing said sealing relation with said substantially cylindrically shaped outer wall.

12. The storage tank according to claim 11, wherein said selectively openable and closable second valve means includes an annular flow ring disposed at the lower end of said reserve tank, with said flow ring having a plurality of flow orifices for permitting said flow of pressurized combustible fluid from said reserve tank to said main tank, and a centrally disposed rod-receiving aperture for receiving said elongate rod member in sliding through passing relation therein.

13. The storage tank according to claim 12, wherein said reserve tank is mounted in removable relation within said main tank.

14. The storage tank according to claim 13, wherein said reserve tank is mounted in removable relation on said main tank, as aforesaid by means of a male threaded portion disposed on said substantially cylindrically shaped outer wall engaging a co-operating female threaded aperture in said main tank.

15. The storage tank according to claim 14, wherein the height of said reserve tank and the width of said reserve tank are in a ratio of greater than 8:1.

* * * * *